US005799790A

United States Patent [19]

Ziegert et al.

[11] Patent Number: 5,799,790

[45] Date of Patent: Sep. 1, 1998

[54] THERMOFORMED TRAY FOR THE PACKAGING OF SYRINGE BARRELS

[75] Inventors: Günter Ziegert, Frankfurt; José Luis Suárez Oviedo, Walluf, both of Germany

[73] Assignee: Hoechst Aktiengesellschaft, Frankfurt, Germany

[21] Appl. No.: 681,814

[22] Filed: Jul. 29, 1996

[30] Foreign Application Priority Data

Jul. 31, 1995 [DE] Germany ..... 195 27 992.1

[51] Int. Cl.[6] ..... B65D 85/20

[52] U.S. Cl. ..... 206/443; 206/364; 206/446; 206/592

[58] Field of Search ..... 206/365, 366, 206/443, 446, 485, 497, 528, 570, 571, 585, 592, 594, 364; 53/449

[56] References Cited

U.S. PATENT DOCUMENTS

| | | | |
|---|---|---|---|
| 3,207,302 | 9/1965 | Hobbs | 206/366 |
| 3,305,084 | 2/1967 | Higgins et al. | 206/366 |
| 4,036,364 | 7/1977 | Ambrose | 206/497 |
| 4,142,633 | 3/1979 | Raghavachari et al. | 206/366 |
| 4,149,635 | 4/1979 | Stevens | 206/571 |
| 4,399,157 | 8/1983 | Caporaso | 206/585 |
| 4,657,138 | 4/1987 | Watson | 206/366 |
| 5,057,282 | 10/1991 | Linder | 206/366 |
| 5,080,225 | 1/1992 | Russo et al. | 206/443 |
| 5,291,997 | 3/1994 | He et al. | 206/366 |

FOREIGN PATENT DOCUMENTS

| | | | |
|---|---|---|---|
| 0719712 | 7/1996 | European Pat. Off. . | |
| 2315868 | 12/1977 | France | 206/443 |
| 2201650 | 9/1988 | United Kingdom . | |
| WO 92/12743 | 8/1992 | WIPO . | |

*Primary Examiner*—Jimmy G. Foster
*Attorney, Agent, or Firm*—Frommer Lawrence & Haug LLP

[57] ABSTRACT

The invention relates to a packaging for syringe barrels, wherein the packaging has a thermoformed tray (1) which is provided with a plurality of compartments (2) for receiving the syringe barrels (3). The packaging according to the invention has in comparison with a conventional packaging the advantages that disposal of a single type of material and recycling are possible, that packaging material is saved and that the weight and volume of the packaging are reduced.

3 Claims, 2 Drawing Sheets

THERMOFORMED TRAY FOR THE PACKAGING OF SYRINGE BARRELS

BACKGROUND OF THE INVENTION

The invention relates to a packaging for syringe barrels. Packagings of the said type are known and substantially comprise a thermoformed part, a so-called blister which is made of plastic, generally polyvinylchloride, serves for receiving the syringe barrels and is sealed with an aluminum foil in order thus to ensure the originality and hygiene of the syringe barrels. These sealed blisters are stored, and shipped, in folding cartons. This type of packaging requires a relatively high outlay on packaging material, which moreover cannot be disposed of as a single type of material.

The invention is intended to remedy this.

SUMMARY OF THE INVENTION

According to the invention, this takes place by means of a packaging of the type mentioned at the beginning, wherein the packaging has a thermoformed tray which is provided with a plurality of compartments for receiving the syringe barrels.

DETAILED DESCRIPTION OF THE INVENTION

The invention consequently relates to a packaging for syringe barrels, wherein the packaging has a thermoformed tray which is provided with a plurality of compartments for receiving the syringe barrels. Special configurations of the packaging according to the invention emerge from claims 2 to 4.

Any one or a number of the individual features described in the claims may also respectively constitute in themselves individual solutions according to the invention, and the features of the embodiments can also be combined in any way desired.

The invention further relates to a process for packing syringe barrels, wherein the syringe barrels are introduced into the compartments of thermoformed trays and subsequently packed into a folding carton. There is a special embodiment wherein a plurality of the folding cartons with the syringe barrels are stacked to form units and these units are packed into a full film wrapping or a film shrink-wrap or into a further folding carton. Suitable materials for the thermoformed trags are the usual plastics, preferably polypropylen, polyethylene, polystyrene or polyethylenetherephthalate.

The packaging according to the invention has in comparison with the conventional packaging the advantages that disposal of a single type of material and recycling are possible, that packaging material is saved and that the weight and volume of the packaging are reduced, which in total leads to a considerable cost reduction. Correspondingly, the process according to the invention is considerably more simple than the conventional process.

BRIEF DESCRIPTION OF THE FIGURES

One possible configuration of the packaging according to the invention is described in more detail below with reference to FIGS. 1 to 3, in which.

Since the drawings speak for themselves, it is sufficient to note a number of special details:

The compartments 2 are shaped such that the syringe barrels 3, which enter with their crimped cap, the contact location 5, into the compartments 2, can be easily held in a clamping manner. The contact location 5 is thereby also protected against contamination and damage during transit.

Figure 1:
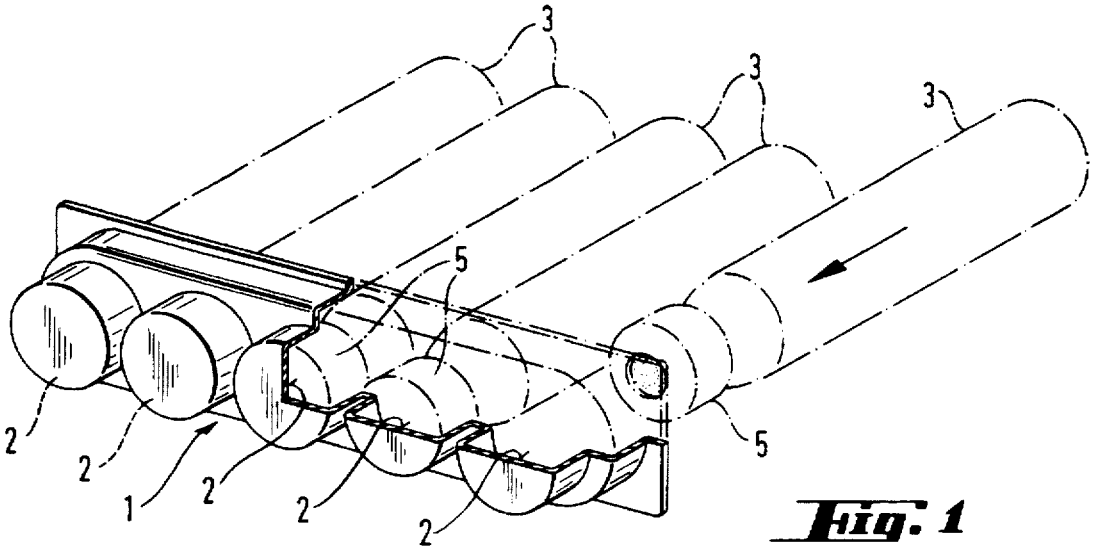
FIG. 1 shows a thermoformed tray 1, partly broken away in section, with compartments 2 and syringe barrels 3.
Figure 2:
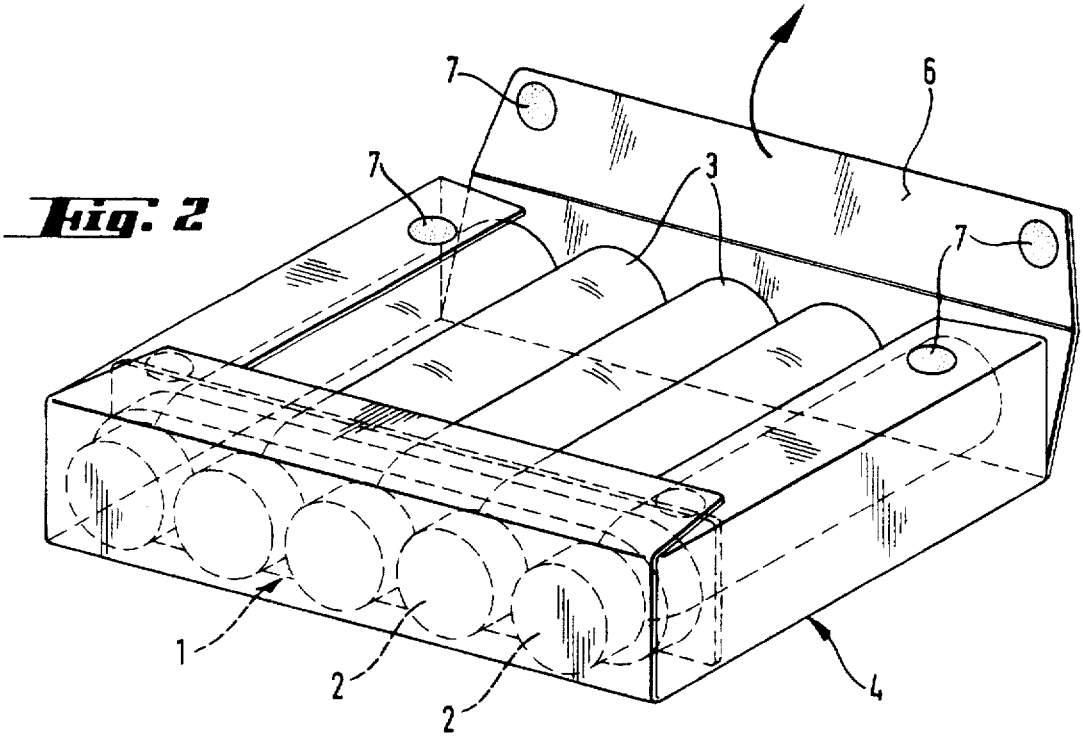
FIG. 2 shows a folding carton 4 with an opening flap 6, adhesive locations 7 and with an inserted thermoformed tray 1, which is fitted with syringe barrels 3.

In a way corresponding to FIG. 2, the opening flap 6 is broken open at the adhesive locations 7, destroying the tamper-proof seal. The folding carton 4 can then be opened in the direction of the arrow. The contents are exposed for removal.

Reclosing is performed by pushing the opening flap 6 into the interior of the folding carton or by applying pressure again to adhesive locations 7 formed as permanent adhesive locations.

Figure 3:
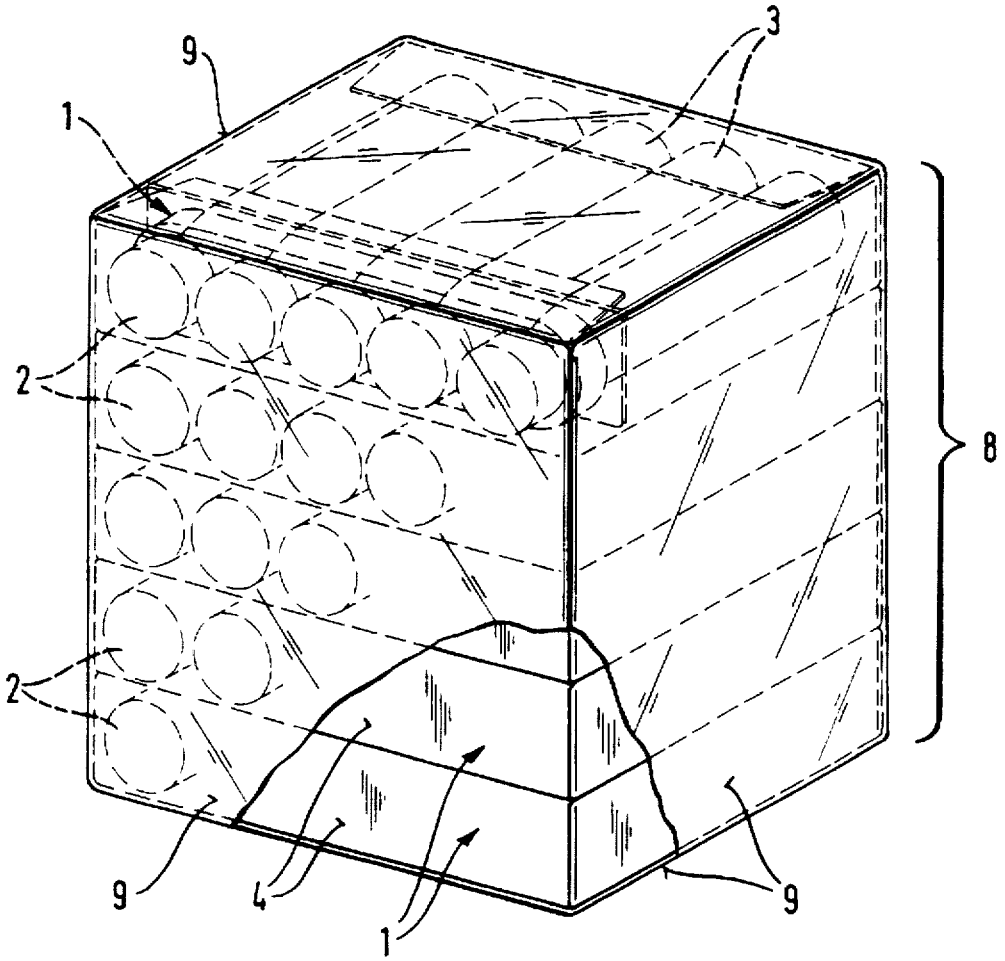
FIG. 3 shows a stack unit 8 in a film shrink-wrap 9.

Filled folding cartons 4 may be combined to form blocks in units 8 of, for example, five or ten items. These blocks can then be packed in a modular manner into a full film wrapping or film shrink-wrap 9 or into a further folding carton (cf. FIG. 3).

We claim:

1. A packaging for a syringe barrel comprising:

an elongated syringe barrel (3) having a length and including a cap at one end;

a thermoformed tray (1) having a plurality of compartments (2), the cap end of said syringe barrel (3) being received in one of said compartments (2) such that said compartment (2) retains the cap in a clamped manner, a major portion of the length of said syringe barrel (3) extending from said one compartment (2); and a folded carton (4) containing said tray and said syringe barrel (3).

2. The packaging as claimed in claim 1, wherein the thermoformed tray (1) is made of a plastic strip and has a plurality of thermoformed compartments (2) for securing the syringe barrels (3).

3. The packaging as claimed in claim 1, wherein the thermoformed tray (1) is made of a plastic strip and has 5 to 10 thermoformed compartments (2) for securing the syringe barrels (3).

* * * * *